United States Patent [19]

Souza, Jr.

[11] 4,383,676

[45] May 17, 1983

[54] RAILING SYSTEM

[76] Inventor: Thomas Souza, Jr., Box 579, 145 Hekili St., Kailua, Hi. 96734

[21] Appl. No.: 310,775

[22] Filed: Oct. 13, 1981

[51] Int. Cl.[3] ..... E04H 17/14; E04H 17/16

[52] U.S. Cl. ..... 256/59; 256/22; 256/31; 256/65

[58] Field of Search ..... 256/1, 21, 22, 24, 31, 256/59, 64, 65; 52/73, 731, 732

[56] References Cited

U.S. PATENT DOCUMENTS

| | | | |
|---|---|---|---|
| 1,677,693 | 7/1928 | Trufant | 256/1 |
| 3,389,931 | 6/1968 | St. John | 256/59 X |
| 3,982,735 | 9/1976 | Fornells | 256/59 |

FOREIGN PATENT DOCUMENTS

| | | | |
|---|---|---|---|
| 619682 | 5/1961 | Canada | 256/59 |

*Primary Examiner*—Richard J. Scanlan, Jr.

[57] ABSTRACT

A railing system is disclosed adapted for use on balconies and the like having masonry floors. The system includes at least one L-shaped post consisting of a vertical section for supporting elongated top and bottom rails having a plurality of spaced apart pickets extending therebetween, and a horizontal section extending a distance from the lower end of the post's vertical section beneath the masonry floor and secured thereto, the top and bottom rails are substantially I-shaped in cross section for imparting rigidity to said system over wide spans.

7 Claims, 4 Drawing Figures

RAILING SYSTEM

BACKGROUND OF THE INVENTION

This invention relates to railing systems and more particularly to one which, due to its novel post and rail construction, has the superior structural rigidity needed for use on the edges of existing or newly constructed balconies of the masonry slab type.

A number of railing constructions have been provided for use along the edges of balconies and walkways of the slab type.

In construction of this nature, a minimum number of posts, aesthetic appeal, maintenance and assembly ease and the necessary structural integrity of the assembled system are the factors of primary importance. Structural integrity takes on added significance when such construction is used on balconies of high rise buildings and the like to insure maximum safety. Generally such railing constructions include at least one vertical post and a top horizontal railing and, most often, a bottom railing parallel to the top railing with a plurality of spaced-apart pickets or several panels extending between the railings. One of the principal reasons of failure of such railing systems over a short period of years resides in the fact that the vertical posts cannot be adequately held structurally in a thin balcony slab which typically measures four inches or so in thickness. The post is usually secured in a hole approximately three inches deep and there surrounded with a grout. One major disadvantage with this type of construction is that water etc., has a tendency to loosen the grout and post over a period of time and because the depth the hole is so shallow, a real safety hazzard develops. In addition, the phenomenon of electrolysis often acts between the metal posts, the grout and the concrete slab to further hasten the deterioration of the joint.

In accordance with the present invention, a railing construction is provided which overcomes the aforementioned disadvantages of the prior art railing constructions. More particularly, the subject railing construction includes at least one post having a vertical section for supporting elongated top and bottom rails having a plurality of spaced apart pickets or a panel extending between the rails and a horizontal section extending a distance from the lower end of the vertical section beneath the masonry floor and secured thereto by bolts or the like. The top and bottom rails have a central member substantially I-shaped in cross-section. The central members are interlocked with an inner plate member which is itself secured to the vertical section and the ends of which are adapted to be connected to side walls of the balcony enclosure. An outer member is also snapped in place on the upper portion of the central member to complete the assemblage. The use of posts which are of stronger construction enables fewer posts to be used and the I-shaped central member of the rail, enables them to be considerably longer in length than those of the prior art to thereby span the increased distance between the posts. A plurality of spaced apart pickets or panel members can be connected to the central members of the top and bottom rails and extend therebetween.

The primary object of the present invention is the provision of an improved railing construction which, due to its novel structural features, can be easily attached to new or existing balconies or walkways of stole-type masonry.

A further object of the present invention is the provision of an improved railing construction which is simple to assemble and install and which, as a result of the inherent structural rigidity of each of the components resulting from their particular shape, enables fewer posts to be used and longer rails between posts thereby reducing costs and effecting a greater aesthetic appeal.

Another object of the present invention is the provision of an improved railing system which has a novel post construction enabling it to be easily mounted on new or existing slab type balconies or walkways resulting in a system with greater overall safety and useful life.

The foregoing objects, and others, will in part be obvious and in part pointed out more fully hereinafter in conjunction with the descriptions of the preferred embodiments of the invention illustrated in the accompanying drawing in which.

DETAILED DESCRIPTION OF PREFERRED EMBODIMENT

Figure 1:
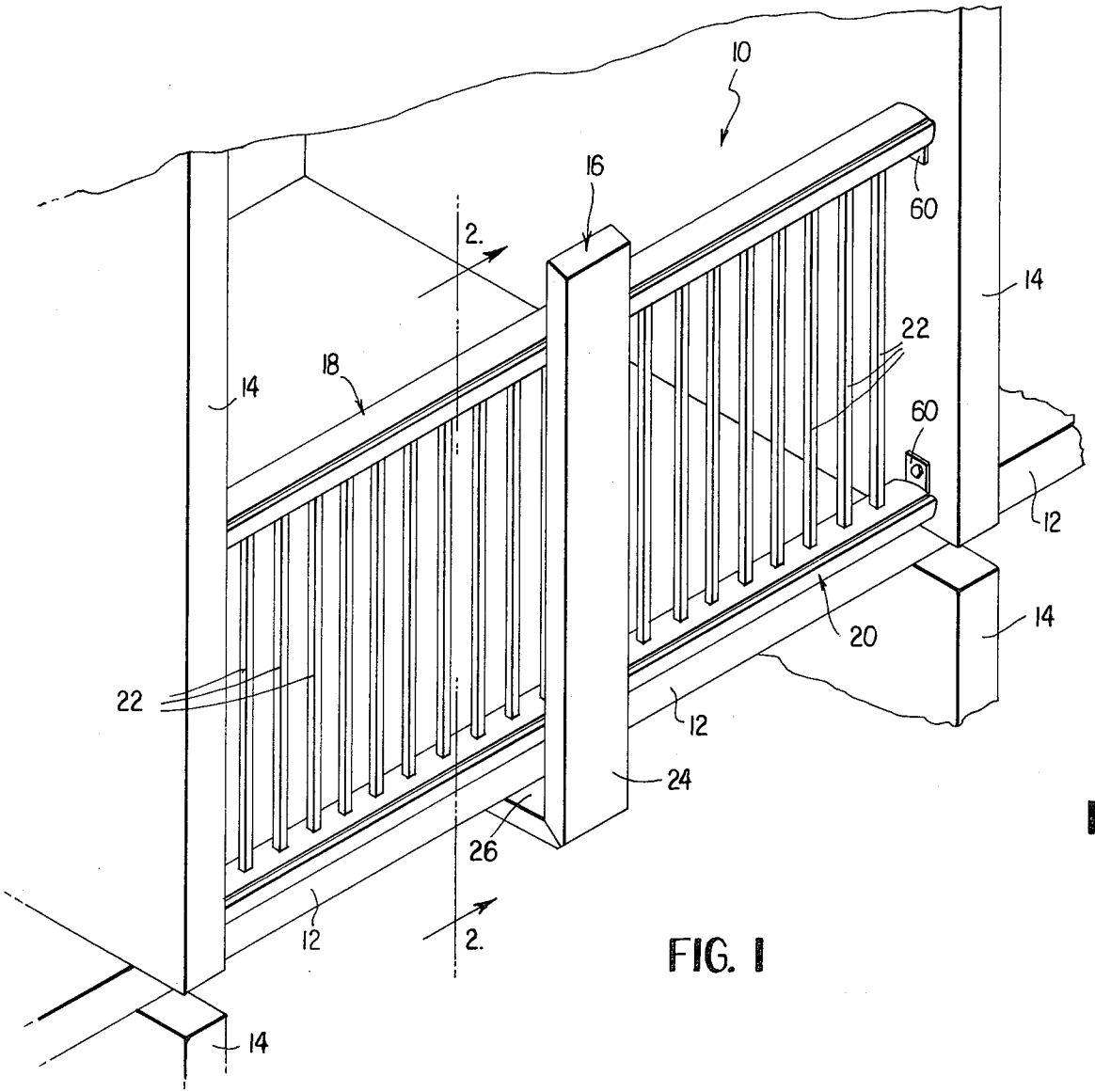
FIG. 1 is a perspective view of the railing system of the present invention installed on a balcony.

Referring now to the drawings where like characters of reference indicate like parts in each of the several figures, FIG. 1 shows, for purposes of illustration only, a railing construction 10 on a balcony of a building having a horizontal concrete slab type floor 12 extending between vertical partition walls 14. The railing construction includes a post 16 secured to the floor 12 in a manner to be more fully described later, a horizontal top rail 18, horizontal bottom rail 20 and vertical pickets 22 between the top and bottom rails.

Figure 4:
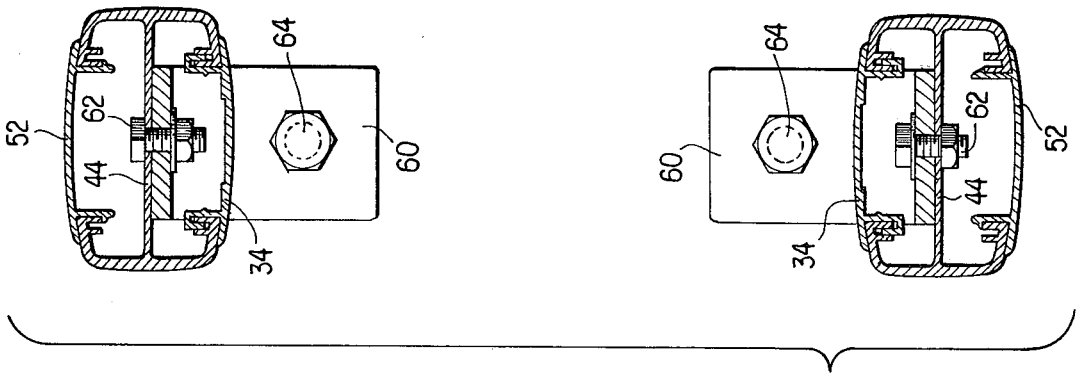
FIG. 4 is a cross-sectional view taken along the lines 4—4 of FIG. 3.
Figure 2:
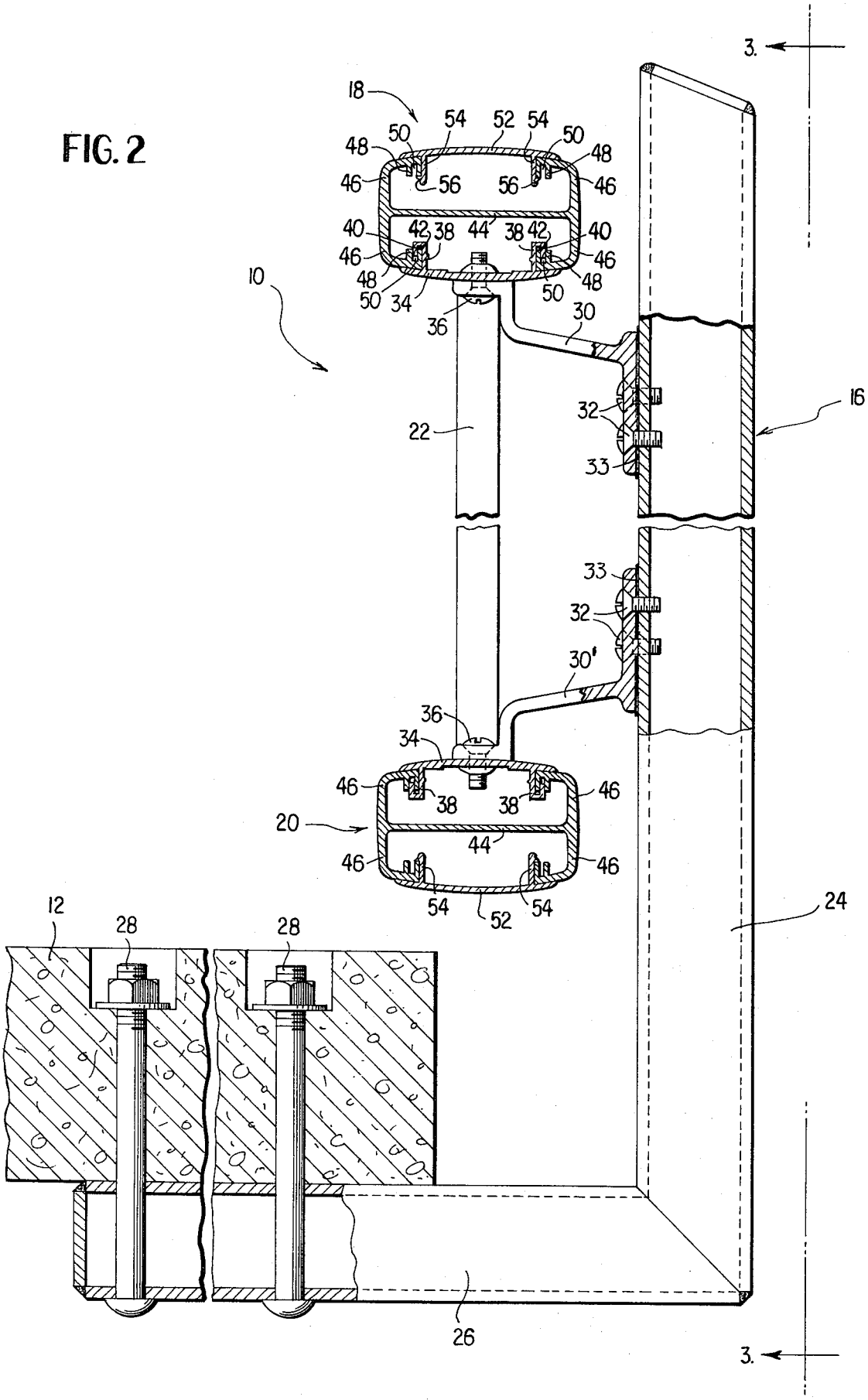
FIG. 2 is a side elevational view in partial cross-section taken along the lines 2—2 of FIG. 1.
Figure 3:
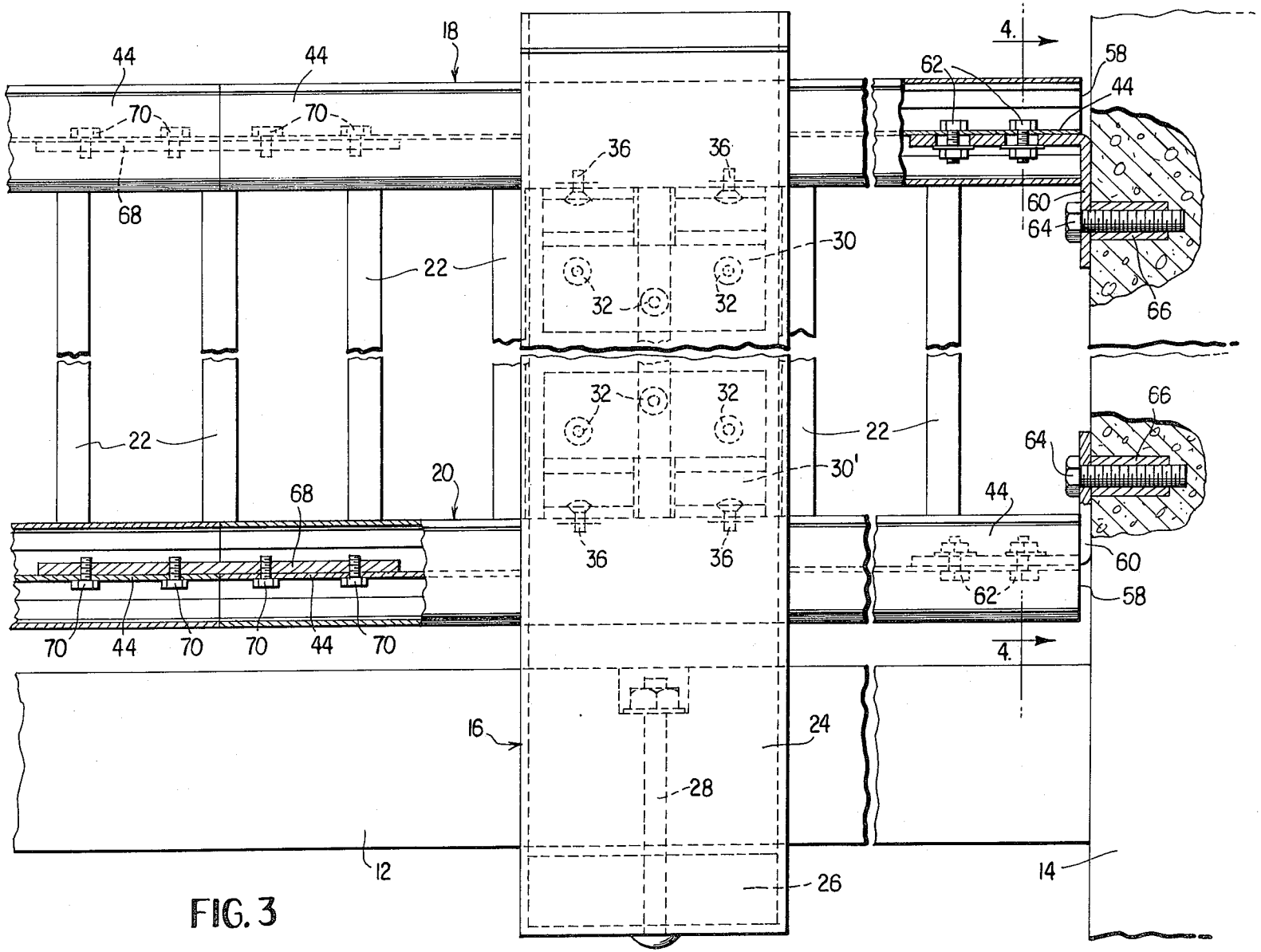
FIG. 3 is a front elevational view in partial cross-section taken along the lines 3—3 of FIG. 2.

The structure of the component parts of the railing construction 10 and the structural interrelationship therebetween is shown in detail in FIGS. 2–4 of the drawings. More particularly, vertical post 16 (only one is shown for simplicity) is made out of tubular heavy gauge, galvanized steel preferably rectangular in cross-section so as to insure maximum support for the center portions of the top and bottom rails 18, 20 respectively. The post 16 consists of a vertical section 24 and a horizontal section 26 joined at substantially a 90° angle. The horizontal section 26 is secured to the underside of the concrete floor 12 by means of bolts 28. An upper support arm 30, preferably made out of aluminum, is secured at one end thereof to the vertical section 24 by screws 32 and is attached to the underside of the top rail 18. In order to eliminate any electrolysis problems from developing between the aluminum support arm 30 and the steel post 16, pads 33 can be positioned therebetween to insulate one from the other.

The top rail 18 comprises an inner, longitudinally extending plate member 34 to which the upper support arm 30 is connected by means of screws 36. The inner plate 34 has a pair of parallel, spaced apart arms 38 integrally formed therewith and extending outwardly therefrom. Each arm 38 has a lip 40 which, together with the arm 38, defines a recess 42 extending the length of the plate. The top rail 18 further comprises a central member 44 substantially I-shaped in cross-section. The I-shaped configuration imparts a structurally rigid characteristic to the railing which enables the unsupported span of the rails to be considerably longer than heretofore possible with conventional railing construction not using such an I-shaped configuration thus greatly reducing overall cost by eliminating additional support posts. The central member 44 has oppositely disposed, spaced apart pairs of projections 46 integrally formed therewith each of said projections further having a pair of ribs 48 extending inwardly from the ends thereof forming a longitudinally extending slot 50. As can best be seen by referring to FIG. 2, the bottom pair of oppositely disposed projections and associated slots 50 are slid on the lips 40 of the inner member 34 the length thereof during makeup and interlock therewith. To complete the construction of the top rail 18, an outer plate member 52 is provided which has integrally formed parallel, spaced apart resillient legs 54. A shoulder 56 is formed on the end of the legs 54 which can be snapped into position on the central member 44 adjacent the ribs 48 to thereby retain the outer plate member 52 in engagement with the projections 46. This snap-on feature of the outer plate member 52 enables various attachments to be made within the central member 44 as will be more fully described later without the necessity of sliding it the length thereof to form an interlock as is necessary with the inner plate member 34. The outer plate member 52 can, for example, be made out of anodized extended aluminum also, or it may be made out of a high grade plastic material.

The bottom rail 20 is identical in construction to the top rail 18 and is secured in an inverted position to the vertical section 24 of part 16 by a support arm 30' also identical to support arm 30 in the same manner as the top rail 18.

Extending between the inner plates 34 of the top rail 18 and bottom rail 20 are a plurality of pickets 22 also preferably made of anodized extruded aluminum. The pickets 22 are secured to the inner plates 34 by any conventional means such as welding or swedging. It should be understood of course that panels not shown, or the like could be substituted for the pickets 22 if more privacy or a different aesthetic is desired.

The ends 58 of the top and bottom rails 18, 20, respectively, are secured, for example, to the vertical partition walls 14 by means of L-shaped brackets 60. The brackets 60 are secured at one end to the central member 44 by means of bolts 62 and to the vertical partition wall 14 by means of bolts 64 anchored in expansion shields 66 as can best be seen by referring to FIGS. 3 and 4. Further, in the event it is necessary to join railing sections 18, 20, a flat connecting plate 68 can be used placed adjacent the central members 44 of the rails to be joined and secured thereto by means of bolts 70 as can also be seen by referring to FIG. 3. The bolts 70 can be tightened before the outer plate member 52 is snapped into place.

Many modifications of the various components of the preferred embodiments disclosed herein will be readily apparent upon reading the foregoing description and accordingly, it is to be distinctly understood that the foregoing descriptive matter is to be interpreted merely as illustrative of the present invention and not as a limitation.

What I claim is:

1. A railing system adapted for use adjacent the edge of a masonry floor, said railing system comprising:

(a) at least one L-shaped post means having a vertical section and a horizontal section at the lower end thereof extending perpendicular to said vertical section, said horizontal section adapted to extend a distance beneath said masonry floor, (b) means adapted to secure said horizontal section to said masonry floor, (c) an elongated top rail secured intermediate the ends thereof to said vertical section, (d) an elongated bottom rail secured intermediate the ends thereof to said vertical section, said top and bottom rails being spaced apart and parallel to each other, and (e) a plurality of spaced apart picketts extending between and secured at the ends thereof to said top and bottom rails.

2. A railing system as set forth in claim 1 wherein said top and bottom rails each include a central member substantially I-shaped in cross-section for increased rigidity.

3. A railing system adapted for use adjacent the edge of a masonry floor, said railing system comprising:

(a) at least one L-shaped post means having a vertical section and a horizontal section at the lower end thereof extending perpendicular to said vertical section, said horizontal section adapted to extend a distance beneath said masonry floor, and secured thereto, (b) elongated top and bottom rails secured to said vertical section in parallel, spaced apart relationship to each other, said top and bottom rails each comprising an inner plate member attached to said post, said inner plate member including a pair of parallel, spaced apart arms extending therefrom each arm of which has a lip defining a longitudinally extending recess, a central member being substantially I-shaped in cross-section, said central member having first and second oppositely disposed, spaced apart pairs of projections, each of said projections further having a pair of ribs extending from the ends thereof forming a longitudinally extending slot therebetween, said slots of said ribs of said first pair of projections being adapted to receive said lips of said inner plate member in sliding engagement therewith, and an outer plate member having parallel spaced-apart legs extending therefrom including a shoulder for and engaging said ribs on said second pair for locking same, and (c) a plurality of spaced apart picketts extending between and secured at the ends thereof to said top and bottom rails.

4. A railing system as set forth in claim 3 wherein said pickets extend between and are attached to said inner plate members of said top and bottom rails.

5. A railing system as set forth in claim 3 wherein said top and bottom rails are secured to said post means by support arms connected at one end thereof to said inner plate members and at the other end thereof to said post means.

6. A railing system as set forth in claim 5 wherein said post means is made of steel and said support arms are made of aluminum and said system further comprises insulation means between said support arms and said post means to eliminate the occurence of electrolysis.

7. A railing comprising:

(a) a central member substantially I-shaped in cross-section, said central member having an inner portion with ends terminating at flange portions extending transverse to said inner portion, each of said flange portions having first and second oppositely disposed, spaced apart pairs of projections on the ends thereof forming longitudinally extending recesses therebetween, (b) a lower plate member including oppositely disposed arms extending therefrom, each of said arms having a lip for insertion into said recesses formed by said projections of said first pair, and (c) an upper plate member having parallel, spaced apart legs including a shoulder for engaging said second pair of projections.

* * * * *